US009033811B2

(12) United States Patent
Bolling, Jr.

(10) Patent No.: US 9,033,811 B2
(45) Date of Patent: May 19, 2015

(54) GOLF TRAINING APPARATUS AND METHOD

(71) Applicant: Charles L. Bolling, Jr., Glen Cove, NY (US)

(72) Inventor: Charles L. Bolling, Jr., Glen Cove, NY (US)

(73) Assignee: Charles L. Bolling, Jr., Glen Cove, NY (US)

( * ) Notice: Subject to any disclaimer, the term of this patent is extended or adjusted under 35 U.S.C. 154(b) by 273 days.

(21) Appl. No.: 13/673,460

(22) Filed: Nov. 9, 2012

(65) Prior Publication Data

US 2014/0135140 A1 May 15, 2014

(51) Int. Cl.
*A63B 69/36* (2006.01)

(52) U.S. Cl.
CPC ..... *A63B 69/3661* (2013.01); *A63B 69/3632* (2013.01); *A63B 69/3641* (2013.01); *A63B 2069/367* (2013.01); *A63B 2225/09* (2013.01)

(58) Field of Classification Search
USPC ..... 473/213, 221, 224, 257, 258, 266, 473/271–277
See application file for complete search history.

(56) References Cited

U.S. PATENT DOCUMENTS

| | | | | |
|---|---|---|---|---|
| 2,807,472 | A | 9/1957 | Hatfield | |
| 3,397,892 | A | 8/1968 | Stahl | |
| 3,703,294 | A | 11/1972 | Fitch | |
| 4,817,954 | A * | 4/1989 | Kubo | 473/227 |
| 4,852,881 | A | 8/1989 | Bellagamba et al. | |
| 5,072,942 | A | 12/1991 | Hurley | |
| 5,265,876 | A | 11/1993 | Moon | |
| 5,421,579 | A * | 6/1995 | Uebele, Jr. | 473/229 |
| 5,441,275 | A | 8/1995 | Yoshishita | |
| 5,743,805 | A * | 4/1998 | Richter | 473/213 |
| 7,056,224 | B1 | 6/2006 | Keyes | |
| 7,611,420 | B1 | 11/2009 | Turner | |
| 8,167,734 | B2 | 5/2012 | Boldin | |
| 2004/0185957 | A1 | 9/2004 | Peek | |
| 2005/0119059 | A1 | 6/2005 | Marshall | |
| 2006/0240903 | A1 | 10/2006 | Cardosi | |
| 2008/0242437 | A1 * | 10/2008 | Taylor | 473/269 |

OTHER PUBLICATIONS

"The No-Backswing Swing Details," Golf.com, Oct. 17, 2007.
"Golf Training Aids from Explanar," Explanar.com, 2011.

* cited by examiner

*Primary Examiner* — Nini Legesse
(74) *Attorney, Agent, or Firm* — Duane Morris LLP

(57) ABSTRACT

An apparatus and method for golf training includes a system of links and a holder for holding a golf club in an optimal position for beginning a golf swing at initiation of a downswing, which eliminates a backswing of the club, and the holder being adapted to separate from the club, wherein the entire apparatus separates from the club during a downswing of the club.

20 Claims, 10 Drawing Sheets

GOLF TRAINING APPARATUS AND METHOD

FIELD OF THE INVENTION

The present invention relates to a golf training apparatus and a method for training a golf swing.

BACKGROUND

U.S. Pat. No. 8,167,734 describes a golf training device, which guides a golf club throughout a complete golf swing. A person grips the golf club, and performs the complete golf swing by swinging the club back, in a backswing, then down and through in a downswing or forward swing. FIG. 1 of the patent depicts a person at address or "set-up," ready to initiate a backswing. The training device has a guiding-arm and a resistance-arm, both of which guide the golf club at address and throughout the backswing. FIG. 4 depicts a person swinging a golf club to the top of the backswing, while the club is being guided by the guiding-arm and the resistance-arm. FIG. 5 depicts a person performing a forward swing, or downswing, while the resistance-arm pushes on the golf club to speed up the swing.

A need has long existed for a golf training device or apparatus to begin guidance of a golf club at initiation of a downswing, which renders unnecessary a need for guidance of the club during a backswing. Further the golf training apparatus should permit performance of a downswing without further guidance of the club by the training apparatus, which will develop a trainee's feel for performing the downswing of a proper golf shot without a training device.

SUMMARY OF THE INVENTION

A golf training apparatus is provided for training a golf swing. Advantageously, the apparatus includes a system of links and a holder for holding a golf club in an optimal position for beginning a golf swing at initiation of a downswing, wherein the apparatus is disposed to eliminate a backswing of the club; and the holder is adapted to separate from the club, wherein the entire apparatus separates from the club during a downswing of the club.

The premise of the apparatus is that a golf swing is best trained by beginning the golf swing at the top of the backswing. Golfers of varying proficiency and varying physical characteristics experience difficulty in performing backswings correctly from their address positions or set-up. This leads to difficulty in being able to position a golf club correctly at the top of their backswings. Each golfer possesses different individual dimensions and proportions and flexibility, which determines where to position a golf club in an optimal position at the top of a backswing. Advantageously, the apparatus holds a golf club stationary in optimal position from which to initiate a downswing, for a person to be trained to apply a proper golf grip and experience performance of a golf swing to begin at the top of the backswing. The apparatus is capable of being scaled to the individual physical characteristics of a person. The entire apparatus separates from the club during a downswing to be performed by a person to be trained, wherein a remainder of the downswing is performed free of the entire apparatus, which develops a trainee's feel for the downswing of a proper golf shot. The entire apparatus is behind the person during performance of a downswing, which avoids a fear of seeing the apparatus while performing a downswing, and further avoids a fear of striking the apparatus with the club.

The top of the backswing occurs where the golf club changes direction, from a backswing to a downswing. During a golf swing, the golf club is in motion except at the top of the backswing. A momentary pause in the golf club can occur, the duration of which depends on the tempo and rhythm of the golf swing being performed differently by each individual golfer.

An embodiment of a golf training apparatus for training a downswing of a golf club includes a system of links and a holder for holding a golf club in an optimal beginning position from which to begin a downswing, without a backswing of the club preceding the beginning position. The club is held at an optimal position for initiating a downswing of the club. The holder is adapted to separate from the club, for example, by being open all along the top thereof. According to one embodiment, a person to be trained applies an optimal grip on the club while the club is held by the holder in optimal position at the top of the backswing, followed by lifting the club up, to separate the holder and the club, and then bringing the club downward to an address position while having the same optimal grip as was applied at the top of the person's backswing.

According to another embodiment, the holder is adapted to move with the club at initiation of the downswing swing by a person to be trained. Further, the holder is adapted to leave the club at a beginning of the downswing, wherein the entire training apparatus separates from the club, and the downswing is performed without further assistance by the training apparatus.

Further, the apparatus can hold the golf club stationary in said optimal position, in preparation for a person to form a properly configured golf grip on the club, in order to experience both a proper grip and the club being held in the optimal position. By way of such an experience, the apparatus trains a person to apply an optimal grip while the club is held in the optimal club position for initiating a downswing of the club. Further, the apparatus positions the golf club in a correct downswing plane along which the club begins to traverse at initiation of a downswing. Further, the apparatus can hold the golf club stationary in said optimal position, and resists a tendency to initiate an inadvertent backswing movement that would exceed the optimal position at initiation of a downswing.

Further, the apparatus is adjustable to correspond with dimensions, proportions and flexibility of an individual person, and positions a golf club in an optimal position for the individual person to initiate a downswing of the club.

An advantage of the invention resides in the golf training apparatus holding the golf club stationary in said optimal position in preparation for a person to form a golf grip and initiate a downswing of the club, which bypasses a backswing and bypasses a need for guidance of the club during a backswing.

In the training apparatus, a holder is constructed for holding the golf club, and the holder leaves the club during a downswing of the club by a person to be trained. Thereby, the club is initially held stationary in optimal position at initiation of a downswing. Further, the apparatus separates from the club during the downswing for performance of a downswing of the club without any further guidance, physical or otherwise, by the training apparatus.

Embodiments of the invention will now be described by way of example with reference to the accompanying drawings.

DETAILED DESCRIPTION

Figure 1:
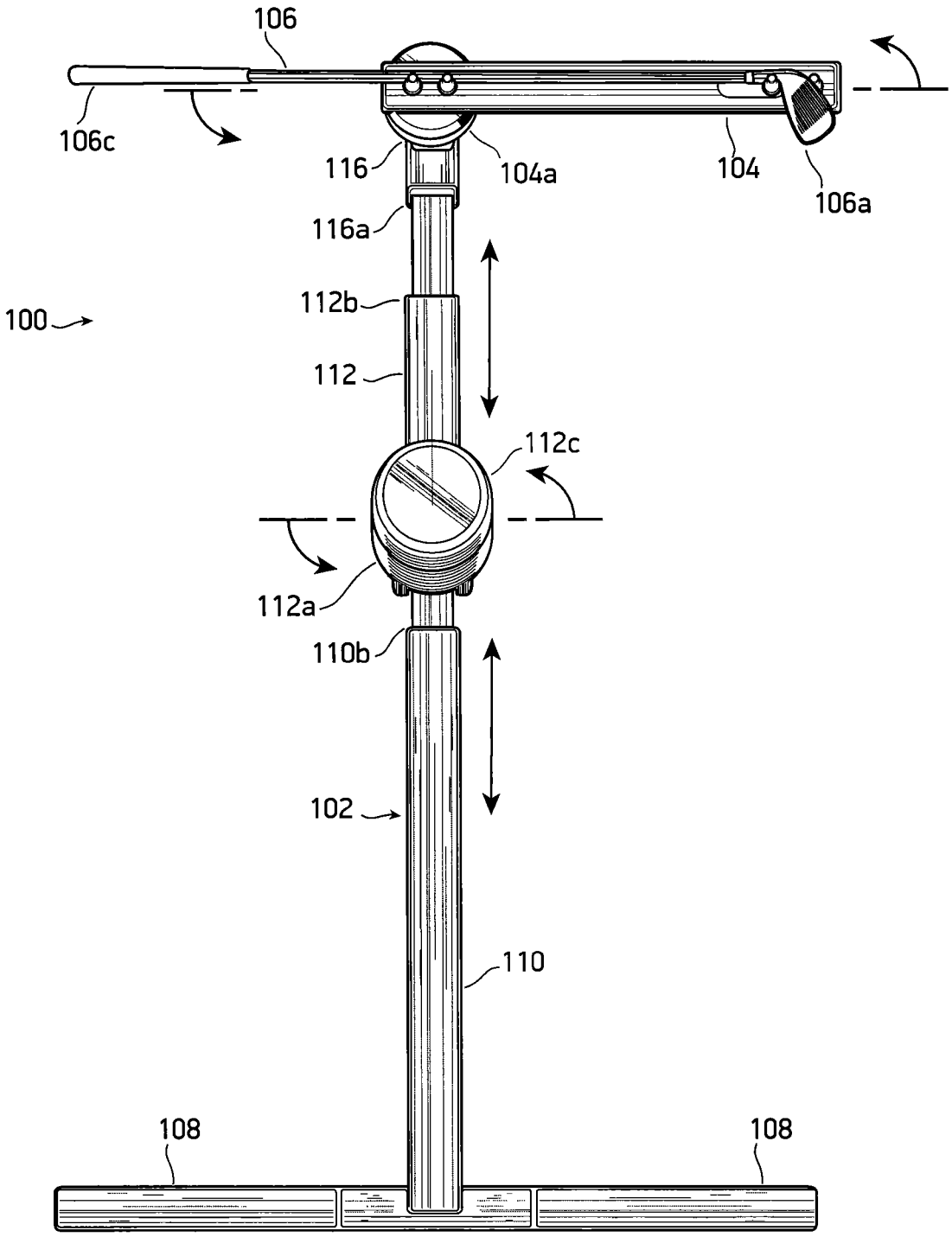
FIG. 1 is a front elevation view of an embodiment of an apparatus for golf training, the apparatus having a system of links and a holder holding a golf club in preparation for a person to be trained.
Figure 2:
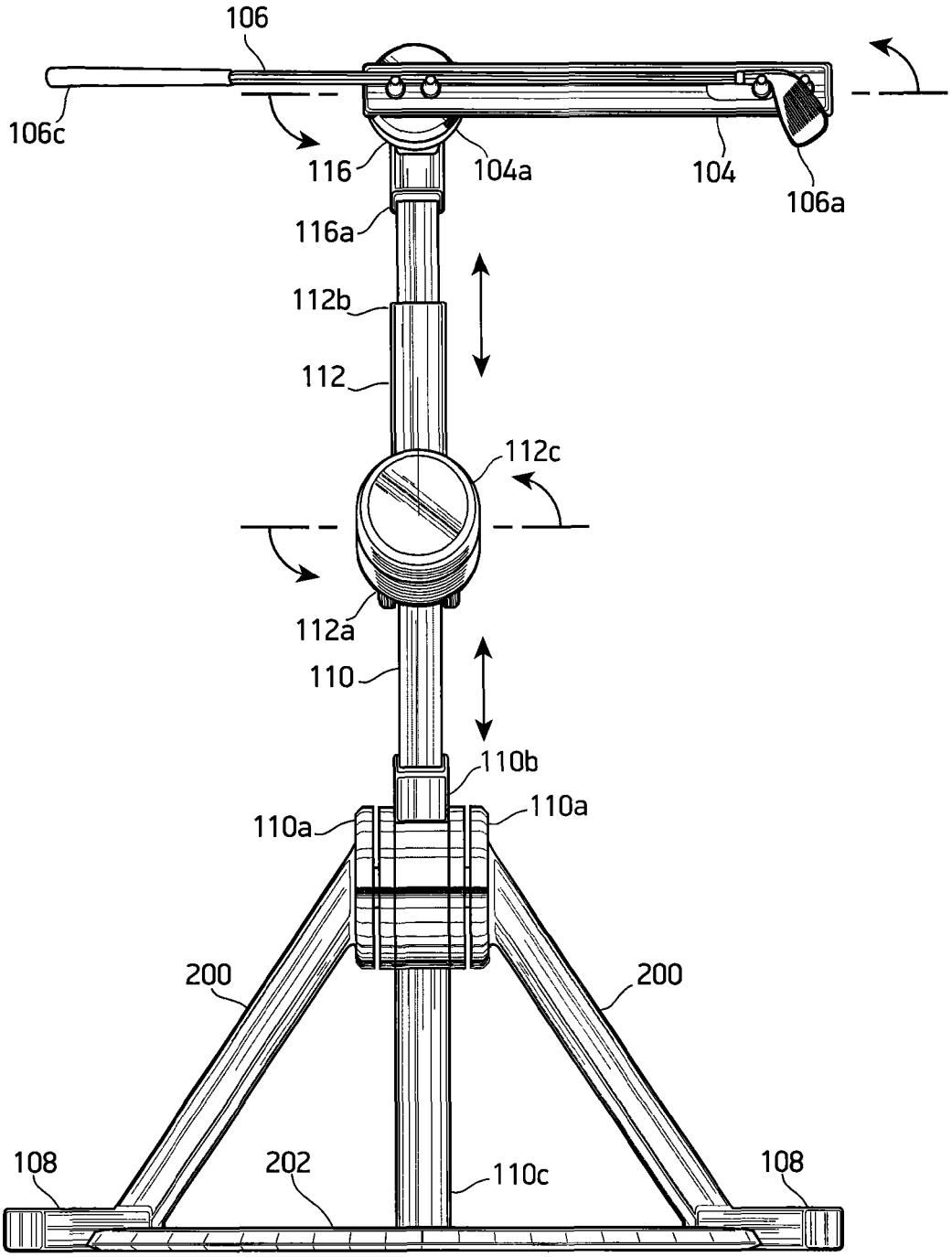
FIG. 2 is a front elevation view of another embodiment of an apparatus for golf training, the apparatus having a system of links and a holder holding a golf club in preparation for a person to be trained.

Each of FIGS. 1 and 2 discloses a corresponding embodiment of a golf training apparatus 100 in preparation for a person to be trained. The apparatus 100 includes a system of links 102 and a holder 104 for holding a golf club 106 stationary in optimal position for initiating a downswing. The apparatus 100 begins a training session by positioning the club 106 in the optimal position even before a person to be trained has gripped the club 106. The club 106 is of standard golf club construction, and includes a clubhead 106*a* at one end of an elongated shaft 106*b* and a hand grip 106*c* serving as a handle covering the shaft 106*b* adjacent an opposite end from the clubhead 106*a*.

The system 100 is foldable and transportable, and is adapted for support on a surface, such as a floor or the ground. For example, an embodiment of the system of links 102 includes a base having two feet 108, FIG. 1B, and a first link 110 or spine link 110 supported on each of the feet 108.

A second link 112 has a second adjustable pivoting connection 112*a* connecting the second link 112 to the first link 110. A third link 116 has a third adjustable pivoting connection 116*a* connecting the third link 116 to the second link 112. The holder 104 is connected to the third link 116.

The first link 110 is adjustable in length, for example, by having first telescopic sections 110*b*. The second link 112 is adjustable in length, for example, by having second telescopic sections 112*b*. The third link 116 is adjustable in length, for example, by having third telescopic sections 116*b*. Each telescopic section is adjusted to length and locked in place.

FIG. 2 discloses another embodiment of an apparatus 100 for golf training. The embodiment of FIG. 2 and the embodiment of FIG. 1 have similar component parts, which are similarly numbered. The embodiment of FIG. 2 differs from the embodiment of FIG. 1, wherein the spine link 110 is supported by its lower end 110*c* against a surface which supports the base 108. The spine link 110 in FIG. 2 is connected by respective adjustable pivoting connections 110*a* to the two feet 108. Similar pivoting connections 110*a* can be provided as an alternative embodiment in FIG. 1. For example, the spine link 110 is pivotable about the connections 110*a* to be adjustable in spine angle relative to vertical.

Each of FIGS. 1 and 2 discloses the system of links 102 and the holder 104 being adjustably scaled according to individual dimensions and proportions and flexibility of the person to be trained. The links are adjustable in respective lengths and are pivotally connected to one another for adjustment into respective orientations to position the club in the same optimal position as would said person for which the links are scaled. The links are representations of many forms, including but not limited to pipes, tubes, shafts, rods, bars, poles, plates, sheets or panels, which are made of materials, including but not limited to metal, wood, plastics materials, or composites of different materials that are un-reinforced or that include fibrous reinforcement.

In addition to being adjustable to the physical characteristics of an individual person to be trained, the system of links 102 and the holder 104 are adjustable to hold clubs of different lengths at different positions at the top of their backswings. For example, a nine iron typically requires a shorter optimal position to initiate downswing than would a four iron. The training device 100 can position the golf club 106 stationary in an optimal position to correspond with longer or shorter standard club lengths, for a person to be trained to grasp the club 106 and form an optimal golfing stance or body position corresponding to either a full body turn, or less than a full body turn commensurate with the club length.

Figure 1A:
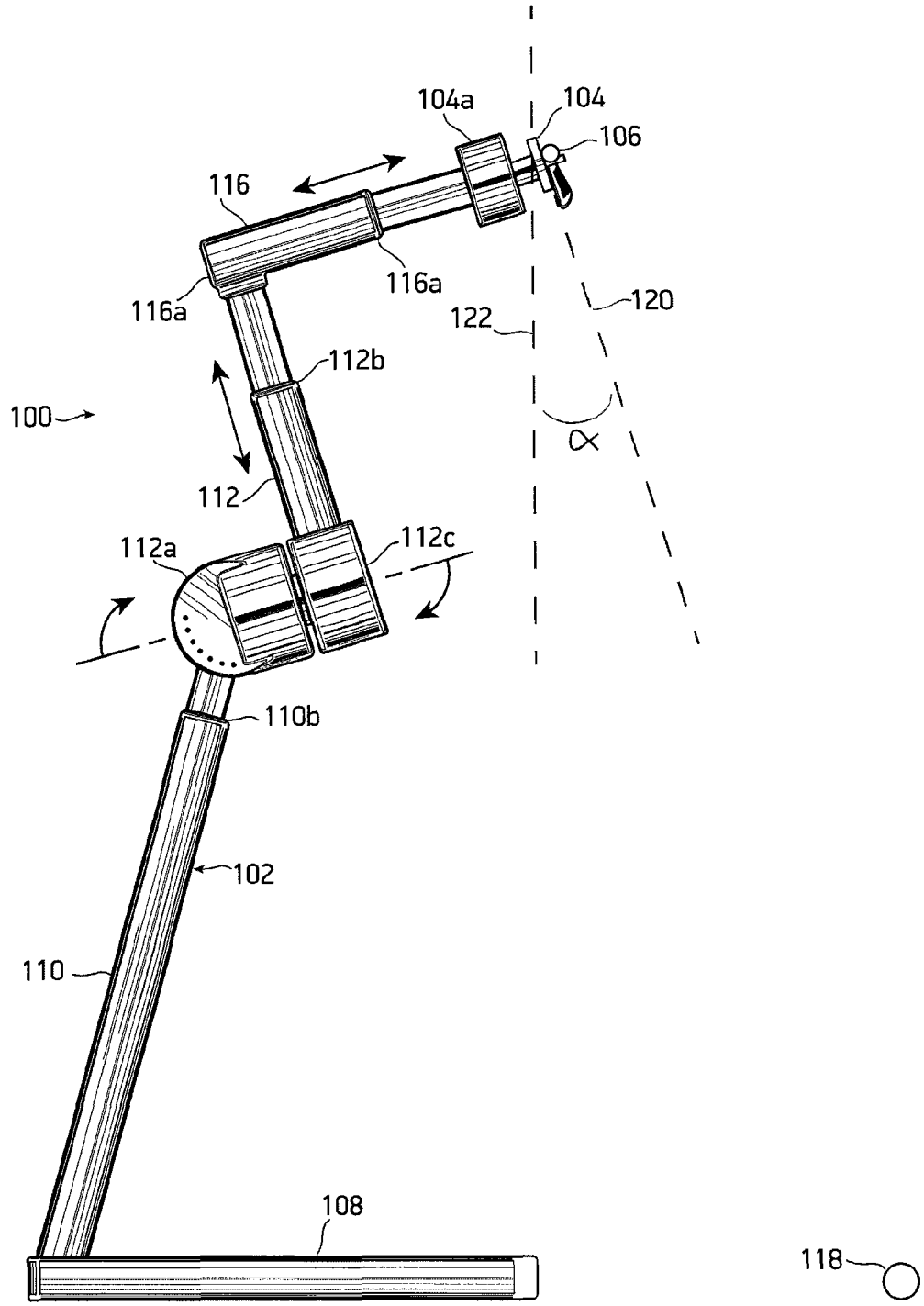
FIG. 1A is side elevation view of the apparatus disclosed in FIG. 1.
Figure 1B:
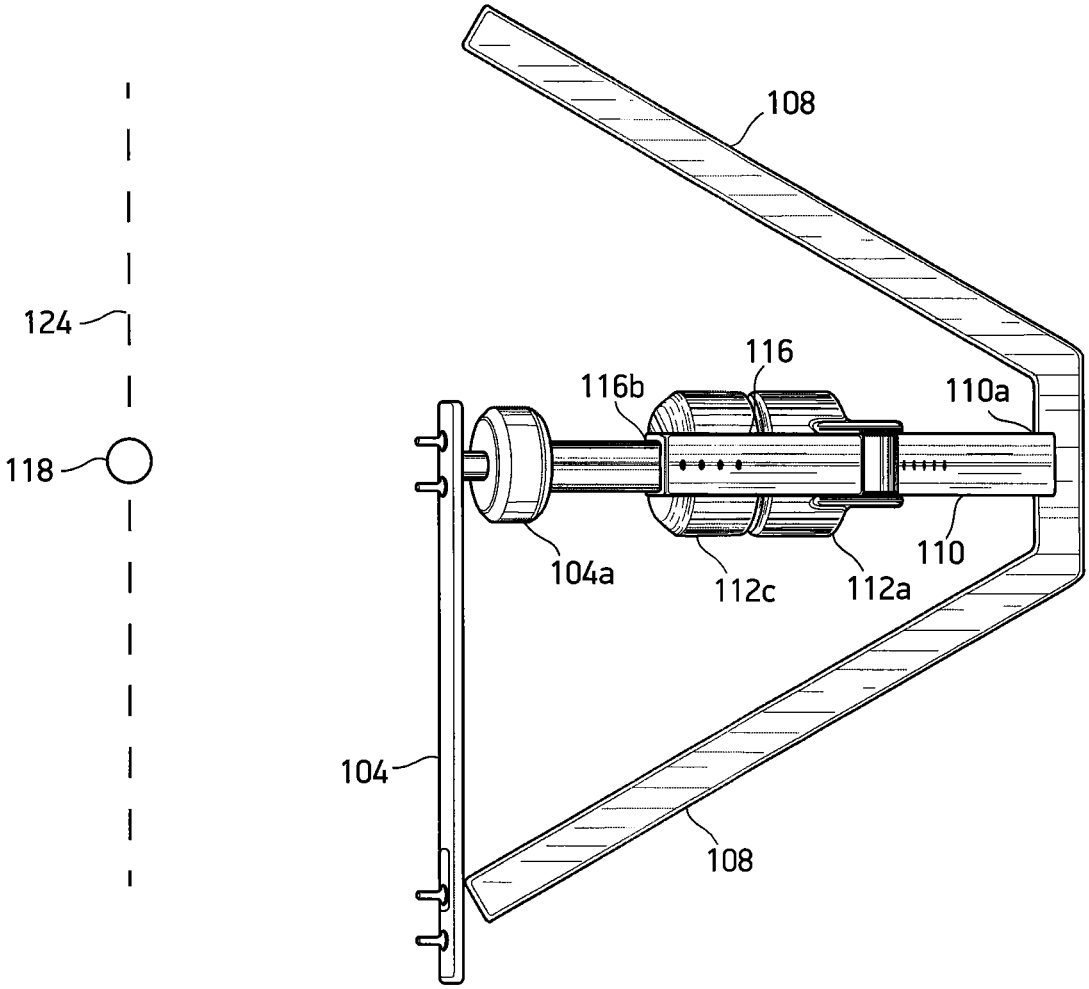
FIG. 1B is a top view of the apparatus disclosed in FIGS. 1 and 1A.
Figure 2A:
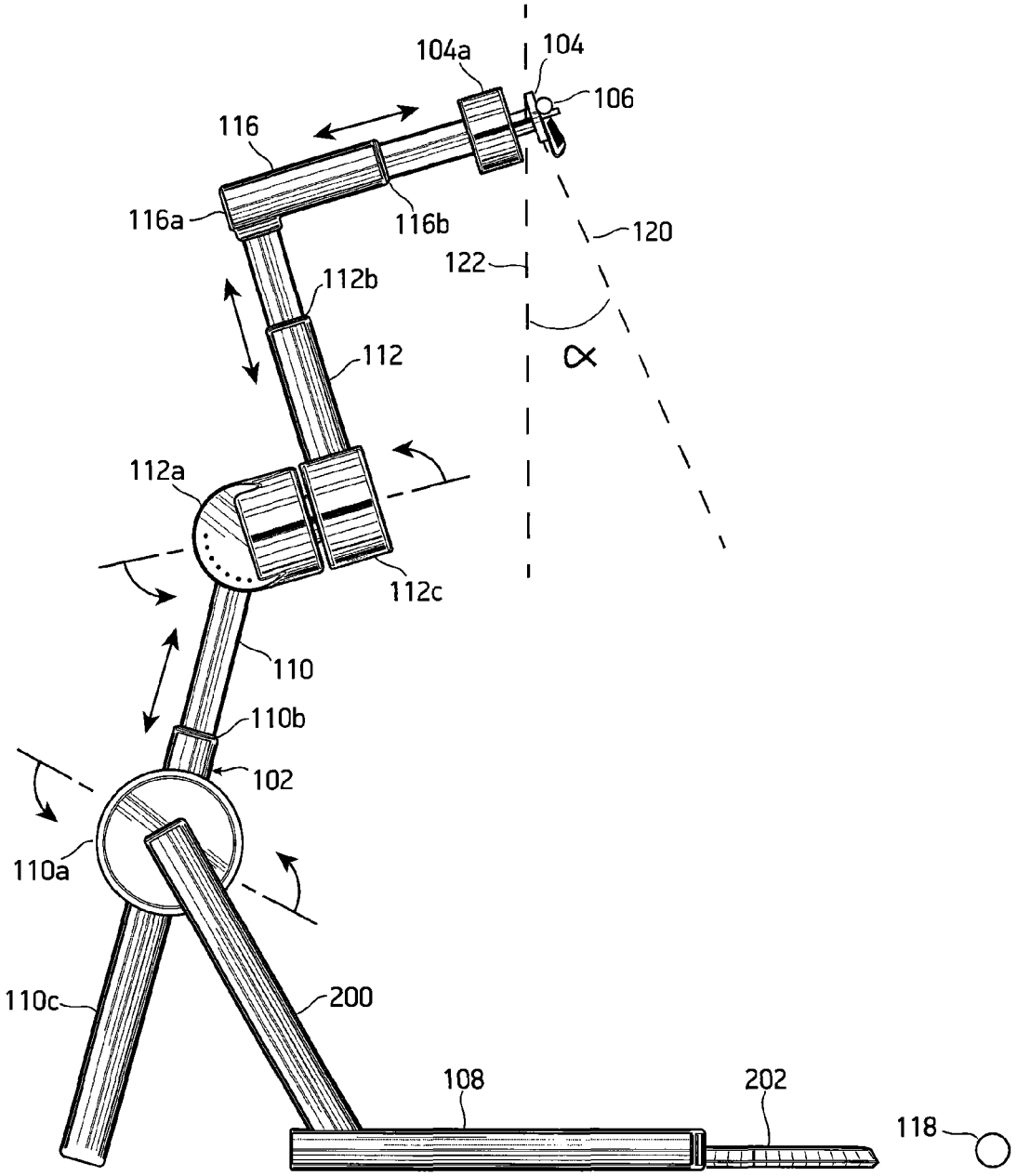
FIG. 2A is side elevation view of the apparatus disclosed in FIG. 2.

Prior to the invention, a trainee was instructed how to form a golf grip on a golf club 106, while the trainee addresses a golf ball, for example, a golf ball 118, FIGS. 1A and 2A. The elements of a golf grip often require correction. "Good golf begins with a good grip. Both hands must be on the club absolutely correctly in order to function as a single cohesive unit." Hogan, Ben; Wind, Herbert Warren; Ravielli, Anthony; "Modern Fundamentals of Golf, The Grip," *Sports Illustrated* Vol. 6, No. 10, (Mar. 11, 1952). However, the grip being formed by a person while at an address position can have subtle variations from an optimal grip, which will contribute to a failure to backswing the club 106 successfully to an optimal position from which to initiate a downswing.

An advantage of the invention resides in the apparatus 100 holding the golf club 106 stationary in said optimal position prior to a person forming an optimal golf grip and an optimal body position for initiating a downswing. The invention is an improvement over training methods prior to the invention, wherein trainees were taught to configure a grip while addressing a golf ball, before a backswing was to begin.

The training apparatus 100 provides a beginning point for the formation of a proper grip on the golf club 106 after the holder 104 has previously positioned the golf club at the optimal position at the top of a backswing for initiating a downswing.

Each of FIGS. 1 and 2 discloses an embodiment of the holder 104 holding the golf club 106 stationary in said optimal position in preparation for a person to grip the club 106. The holder 104 positions the club 106 in the optimal position prior to a person applying a properly configured grip.

The holder 104 holds the golf club 106 stationary in said optimal position for a person to apply a proper golf grip on the club 106 and assume an optimal body position or stance appropriate for beginning a golf swing at a point of beginning a downswing. An optimal body position can be formed after the holder 104 has positioned the golf club 106 at the optimal position.

Figure 3:
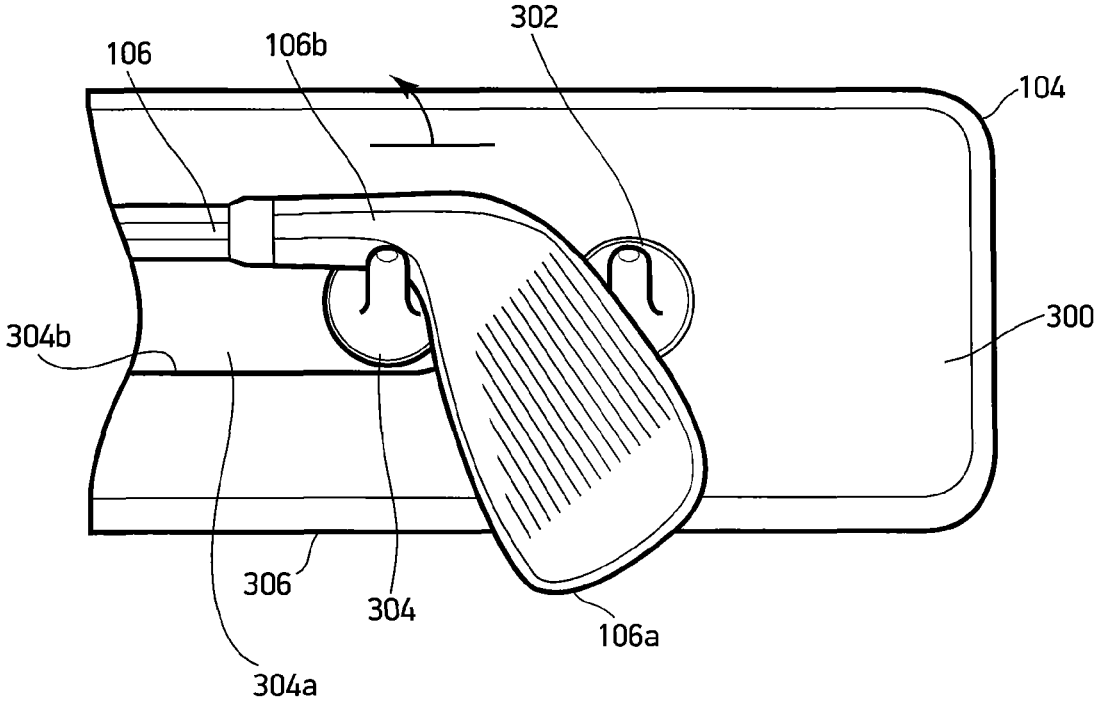
FIG. 3 is a fragmentary view of an embodiment of a holder for holding a golf club in an optimal position for initiating a downswing.

FIG. 3 discloses, at the top of the backswing for a longer club 106, ideally a toe of the club head 106*a* points substantially downward, while in FIG. 1A the club shaft 106*b* is aligned parallel to a target line in the downswing plane 120 that points substantially toward a golf ball 118, FIGS. 1A and 2A. Thereby, the club 106 is in optimal position for a leading edge of the clubhead 106*a* to strike the ball 118 on a downswing and impel the ball on a correct flight path 124, FIG. 1B. The optimal alignment of the club 106 at initiation of a downswing is in the optimal downswing plane 120, which provides a person with the opportunity to begin a proper golf swing at the beginning a downswing, with the club 106 in optimal position at the top of the golf swing and during a beginning portion of the downswing. The holder 104 corrects common errors of a person being trained who would position a golf club 106 out of parallel to the target line 120, which would require the golf swing to compensate for the error, in order to strike the ball 118.

The holder 104 positions the club 106 in correspondence with an individual golfer's optimal position to initiate a downswing: less than horizontal position, or horizontal position or even beyond horizontal position of the club shaft, to correspond with an individual person's physical characteristics for replicating the optimal position. In each of FIGS. 1A and 2A the holder 104 is connected by a pivoting connection 104*a* to the link 116. The pivoting connection 104*a* is rotatably adjustable to rotate the holder 104 into the optimal position, relative to horizontal at the top of the backswing, and to retain the holder 104 in a stationary position at the optimal position. Further, as shown in FIGS. 1 and 2, the holder 104 can rotate counterclockwise from the position shown in FIGS. 1 and 2, for initiating downswings of right-handed clubs, until the holder 104 is stopped from further rotation beyond approximately ninety degrees of rotation. Whenever the downswing of the club 106 is faster than the counterclockwise rotation of the holder 104, the holder 104 separates from the club 106 before the holder 104 rotates approximately ninety degrees. Alternatively, for initiating downswings of left-handed clubs the holder 104 can be adjusted to hold a left-handed club 106, and to rotate clockwise during a downswing, until the holder 104 separates from the left-handed version of the club 106 before the holder 104 rotates approximately ninety degrees, and is stopped from further rotation beyond approximately ninety degrees of rotation.

FIG. 3 is a fragmentary view of an embodiment of a holder 104 for holding a right-handed golf club 106 in an optimal position for initiating a downswing. The holder 104 is open all along a top of the holder 104, which permits separation of the holder 104 from the club 106. An embodiment of the holder 104 includes a flat, planar, plane board 300, which is open all along a top of the holder 104, and which includes one or more pins 304 distributed lengthwise of the board 300 along a flat planar surface 306 of the board 300. Each of the pins 304 projects from the surface 306 of the board 300. In FIG. 3, the elongated, flat planar surface 306 is parallel to the shaft 106*b* of the club 106 being supported by the one or more pins 304. The board 300 and pins 304 align the shaft 106*b* parallel to a target line in the optimal downswing plane 120, FIGS. 1A and 2A pointing to the ball 118. The board 300 can engage against the shaft 106*b*. Above the one or more pins 304, the holder 104 is open along the top to separate from the club 106, for example, during initiation of a downswing. Thus, the holder 104 of the training apparatus 100 separates naturally from the golf club 106 during the downswing, which sets free the club 106 from the entire training apparatus 100.

The holder 104 can be used to position the club 106 in the optimal position. Then a person can apply a proper golf grip and proper golf stance for initiating a downswing of the club 106. The person learns to apply a proper golf grip while the club 106 is held by the holder 104 in the optimal position.

The holder 104 is used to perform different methods after the person applies an optimal golf grip on the club 106. According to one method, the person can lift the club 106 up and away from the holder 104, and practice a golf shot downswing with or without the ball 118 in place. According to another method, the person can lift the club 106 up and away from the holder 104 and bring the club 106 to the address position, for the person to experience the previously learned, optimal golf grip, and continue the golf grip while addressing the ball 118. Then the person is ready to practice a golf shot including both a backswing to the previously learned optimal position, and a downswing, with or without the ball 118 in place. Accordingly, the holder 104 is adapted to separate from the club 106 substantially without moving with the club during performance of a downswing.

According to another embodiment, the holder 104 is adapted to move with the club 106 at a beginning of the downswing, but separates from the club further along the downswing, which sets free the club 106 from the entire training apparatus 100. In FIG. 3, adjacent a clubhead end of the board 300, a pin 302 is adjacent one of the pins 304. Each of the pins 302, 304 projects from a flat surface 306 of the board 300. The pins 302, 304 are spaced apart with a gap to receive a clubhead 106*a* in the gap, while a hosel of the shaft 106*b* registers by gravity against said one of the pins 304. In FIG. 3, said one of the pins 304 is mounted on a sliding plate 304*a*. The sliding plate 304*a* is slidable toward the pin 302 to engage said one pin 304 against the clubhead 106*a*.

Figure 3A:
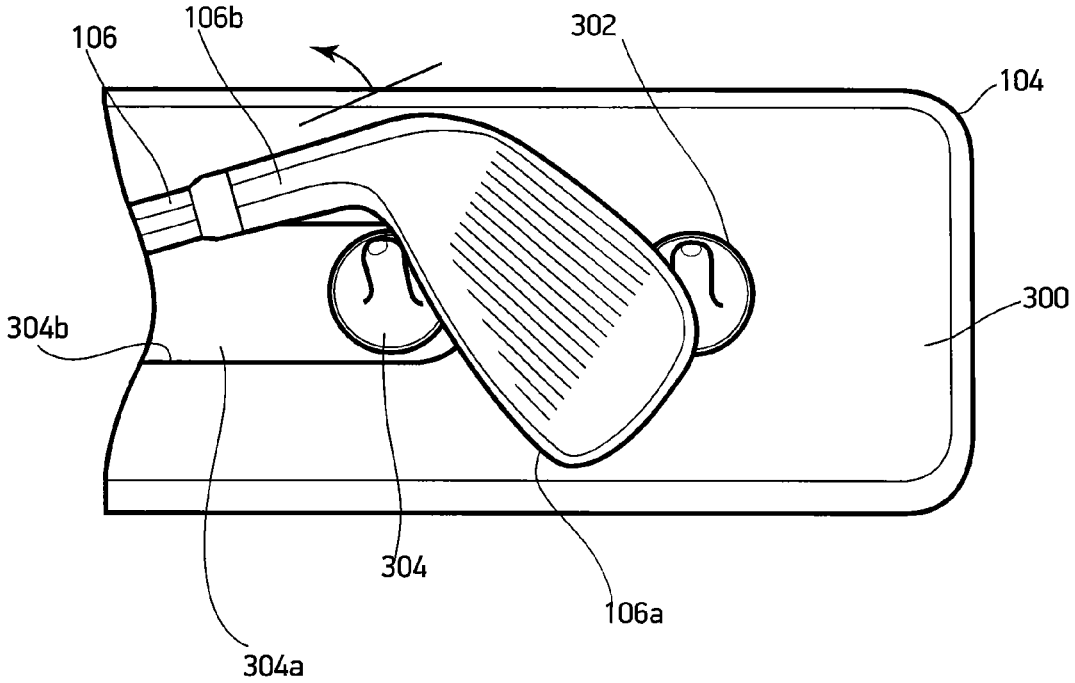
FIG. 3A is a view similar to FIG. 3, depicting the golf club of FIG. 3 at the beginning of a downswing of the club.

With reference to FIG. 3A, at a beginning of a downswing, the clubhead 106*a* urges against said one pin 304, which urges both the pin 304 and the holder 104 to move together with the club 106. Further, the one pin 304 is deflectable upon being urged by the clubhead 106*a* to increase the gap between said pins 302 and 304, and allow their separation from the clubhead 106*a* during the downswing. The one pin 304 is deflectable by the clubhead 106*a* urging the pin 304 and the sliding plate 304*a* to move slidably away from the pin 302 along a recessed track 302*b* in the form of a slot, and allow separation of the pins 302, 304 from the clubhead 106*a* during the downswing. Alternatively, the pin 304 can be deflectable by being hinged or made of deformable material, such as, rubber, to deflect and allow separation of the pins 302, 304 from the clubhead 106*a* during the downswing. The pins 302, 304 on the board 300 can possess different shapes including but not limit to tapered, non-tapered, bulbous, straight or hook shaped.

In FIGS. 1A and 2A the optimal downswing plane 120 is tilted at an optimal angle "alpha" with respect to vertical 122. Further the surface 306 of the board 300 is tilted at the same optimal angle alpha, which aligns the surface 306 of the board 300 substantially parallel with the shaft 106*b* of the club 106.

In FIGS. 1A and 2A the holder 104 has the surface 306 of the board 300 in an imaginary plane at an angle alpha to match the angle alpha of the downswing plane 120. Different persons will have downswing planes at different angles alpha.

In FIG. 3, the flat planar surface of the board is against the backside of the clubhead 106*a* to align the clubhead 106*a* with the toe facing generally downward, and avoid an undesirable "closed" face or "open" face orientation of the clubhead 106*a* at the top of the backswing.

In FIG. 3, the holder 104 trains golfers to avoid exceeding their optimal backswing positions. The pin 302 provides a stop engaged against the clubhead 106*a*, at the sole at the leading edge, to prevent the club 106 from moving beyond the optimal position relative to horizontal, especially while being gripped by a person to be trained. In FIGS. 1 and 2, an end of the shaft 106*b* having the grip 106*c* projects beyond a corresponding end of the holder 104. The grip 106*c* is free of the holder 104 and available for gripping by a person to be trained. Alternatively, the pins 302, as well as the pins 304, can be rigid, or can be deflectable by being hinged or made of deformable material, such as, rubber, to be deflected away by the shaft 106*b* due to frictional engagement with the club 106 during initiation of the downswing.

With reference to FIGS. 1A and 2A, the apparatus 100 enables a person to initiate a downswing of the club 106 along the optimal downswing plane 120. The board 300 provides an embodiment of the holder 104 that is open all along a top of the holder 104, which unloads the club 106 from the open top of the holder 104, and away from the pins 302, 304, and which permits separation from the club 106 during performance of a downswing. The holder 104 being open along the top can have the form of the board 300 and the pins 302,304, and can include other forms including, but not limited to, a channel of U-shaped cross-section open along the top.

A person to be trained grips the club 106 with a proper, applied golf grip onto the club 106, and initiates a downswing by following one of two processes. According to a first process, the person can lift the club 106 upward and remove the club away from the pins 302, 304 of the holder 104, wherein the holder 104 and the club 106 separate before performance of a downswing. The holder 104 unloads the club 106 upwardly from the open top of the holder 104, and away from the pins 302, 304. Thus, the holder 104 of the training apparatus 100 separates naturally from the golf club 106, which sets free the club 106 from the entire training apparatus 100. The club 106 is without further guidance by the apparatus 100, to develop a feel of the downswing being performed without further assistance by the apparatus 100.

Figure 3B:
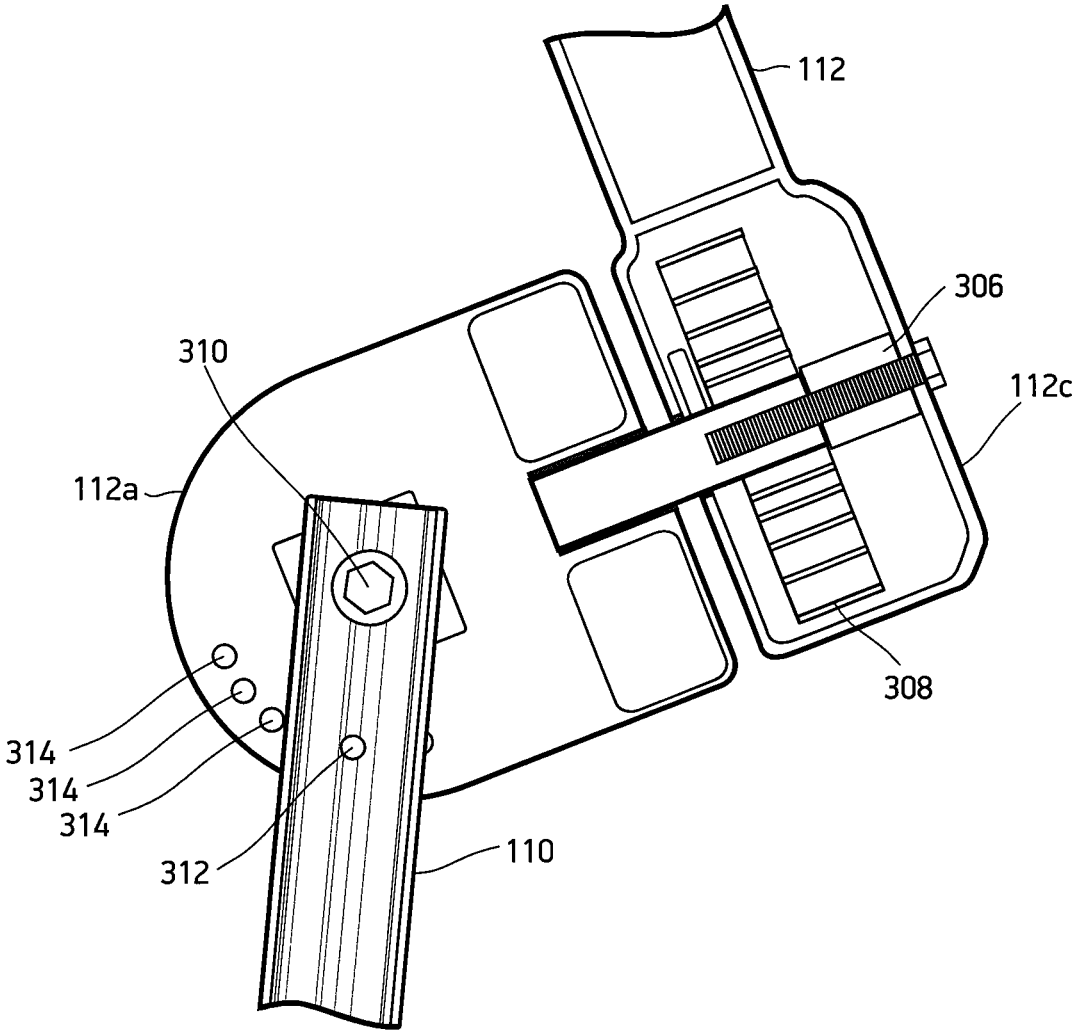
FIG. 3B is a section view of a portion of the apparatus of FIG. 1A or FIG. 2A.
Figure 3C:
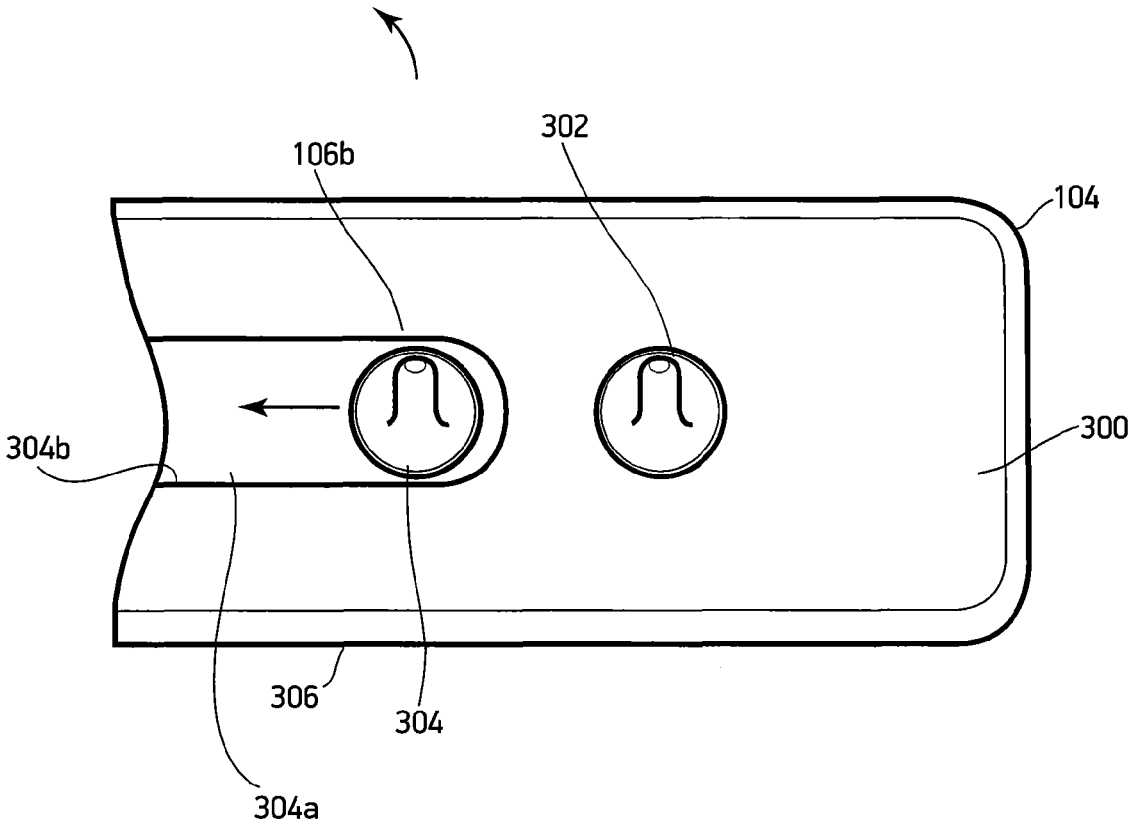
FIG. 3C is a fragmentary view of a sliding element on the holder of FIG. 3.

According to a second process, both the club 106 and the holder 104 are adapted for moving together at the beginning of a downswing, but become separated from each other during the downswing. With reference to FIGS. 1 and 2, the holder 104 and the links 116, 112 are connected together, and revolve together. With reference to FIG. 3B, the link 112 revolves about a shaft 306 of a brake 112*c*, until friction engageable plates 308 of the brake 112*c* engage to stop further revolution through the downswing. More specifically, FIGS. 1A and 2A each shows the angular orientation of the shaft 306 is adjusted to position the link 112 to extend parallel to the optimal downswing plane 120 at the angle alpha, at the beginning of the downswing.

The link 112 is adjustably positioned to the angle alpha by pivotal adjustment of the pivoting connection 112*a*, shown in FIG. 3B. The pivoting connection 112*a* is pivoted about a shaft 310 held by the link 110. A sliding pin 312 extends through the link 110. The pin 312 registers in a socket 314, one of a number of sockets 314 distributed in the pivoting connection 112*a*, for holding the pivoting connection 112*a* stationary in one selected position for holding the link 112 at the angle alpha.

FIG. 3A discloses the club 106 while beginning a downswing. The clubhead 106*a* will begin to move counterclockwise in FIG. 3, and will push against the one pin 304 nearest the pin 302, which urges the holder 104 to move with the club 106 at the beginning of the downswing.

With reference to FIGS. 1A and 2A, the board 300 and pins 302, 304 of the holder 104 hold the club 106, before a downswing is initiated. While the downswing begins, both the club 106 and the holder 104 move together. During the downswing, the club 106 is displaced initially in an arc along the optimal downswing plane 120. However, further along the downswing the holder 104 is adapted to separate from the club 106, for performance of the downswing free of the entire apparatus 100. Advantageously, the club 106 and the holder 104 move together at the beginning of a downswing. Further along the downswing, the holder 104 is adapted to separate from the club 106, and allow the person to accelerate the downswing while striking the ball 118. The board 300 provides an embodiment of the holder 104 that is open all along a top of the holder 104, which permits separation from the club 106. During performance of a downswing, the holder 104 unloads the club 106 from the open top of the holder 104, and away from the pins 302, 304. Thus, the holder 104 of the training apparatus 100 separates from the golf club 106 during the downswing, which sets free the club 106 from the entire training apparatus 100. The holder 104 unloads the club 106 and separates from the club 106 during a beginning portion of the downswing, and then the brake 112*c* engages to stop the holder 104 from further movement with the club. The club 106 is without further guidance by the apparatus 100, to develop a feel of the downswing being performed without further assistance by the apparatus 100.

Figure 2B:
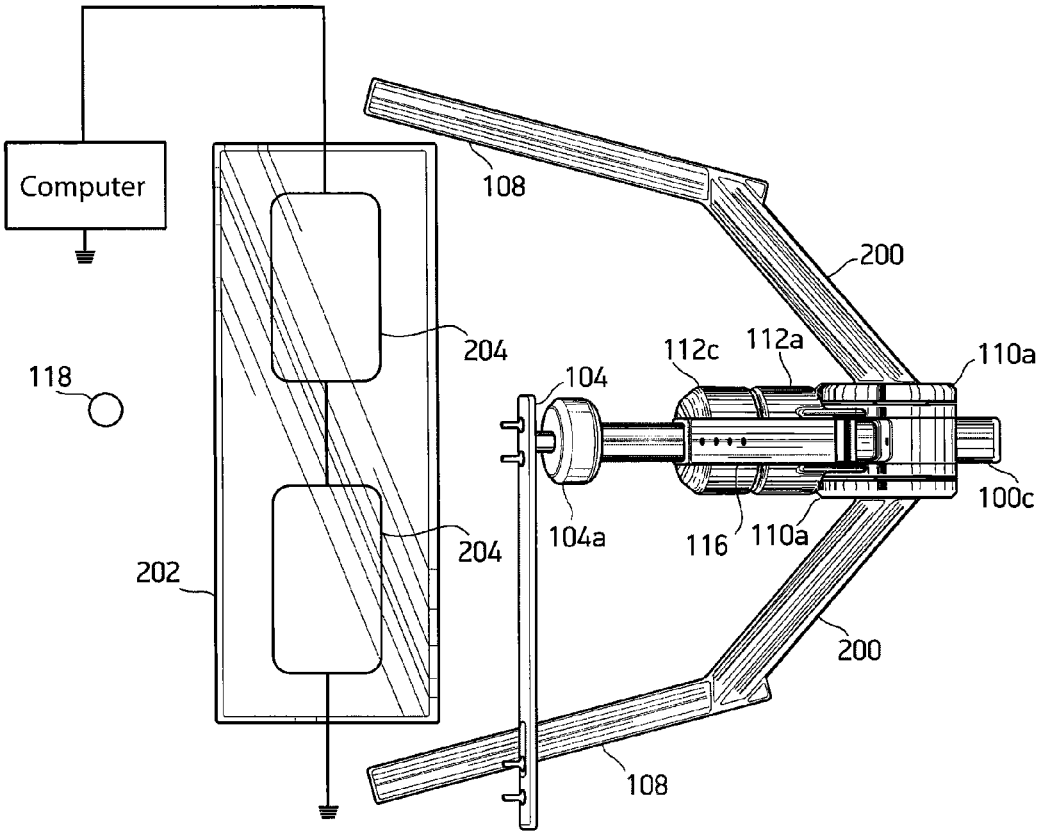
FIG. 2B is a top view of the apparatus disclosed in FIGS. 2 and 2A, accompanied by a training mat for use in combination with either the apparatus of FIG. 1 or the apparatus of FIG. 2.

FIG. 2B discloses an embodiment of a flat mat 202 to be laid in position adjacent to the corresponding apparatus 100 disclosed by either FIG. 1 or FIG. 2. A person to be trained by the apparatus 100 is to stand on the mat 202 with both feet, while the person grips the club 106 being held by the holder 104 at the optimal position for initiating a downswing. Electrical transducers 204, 204 are located in or on the mat 200 in positions beneath the golfer's feet. The transducers 204, 204 sense the golfer's weight on respective feet and convert the weight being sensed into output signals in proportion to the sensed weight. For example, the transducers 204, 204 are similar in operation to using two bathroom scales. The output electrical signals are compared to indicated a relative distribution of body weight between the left foot and the right foot of the golfer while the golfer is in position to initiate a downswing of the club 106. The mat 200 supports the golfer's feet, and trains the golfer to accompany a backswing with a corresponding body weight transfer to the right foot, while being monitored by the transducers. At the top of the backswing, the relative distribution of the weight transfer is detected by the transducers to determine the center of gravity of the golfer while in position at initiation of a downswing. Further, the mat 200 trains the golfer to transfer body weight to the left foot during the downswing, by monitoring the relative distribution of the weight transfer during the downswing. Further, the relative distribution of the weight transfer is detected by the transducers to determine the center of gravity of the golfer during the downswing. A computer, FIG. 2B, monitors and records the center of gravity and the corresponding weight transfers.

A method and system of training and using the apparatus 100 will now be described. The system can be referred to as Optimal Delivery Point™ Golf Instruction and/or Delivery Point™ Golf Instruction. A photograph or video captures a trainee golfer's backswing and body position during a backswing. After measuring the required parameters (height, arm length, trunk diameter, rotational flexibility, shoulder flexibility, thumb flexibility) of the trainee, for example, from data supplied by, and taken from, the photograph or video, a Delivery Point Golf (DPG) Instructor processes the data through DPG computer executed transactions, which determine the configurations of adjustment for the system 100 of links and the holder 104 being adjusted and scaled to the different dimensions and proportions of the individual person.

The system of links 102 and the holder 104 is then scaled, and then is used as described above to position a golf club 106, which is referred to as the Optimal Delivery Point (ODP) in preparation to train the trainee golfer for whom the system was scaled. The holder 104 holds the golf club 106 in a beginning stationary position in preparation for a person to grip the club 106 with a correct golf grip and assume a correct body position for initiating a downswing of the club 106. A golf instructor can instruct the person to be trained to apply a correct golf grip, and to assume an optimal position to initiate a downswing. Further, a downswing of the golf club 106 initially swings the club 106 and the holder 104 together until the holder 104 revolves and unloads the club 106 outward from the open top of the holder 104. The person can rehearse a downswing that becomes free of the holder 104. Further, such a downswing can include striking a golf ball 118 that has been positioned for being struck by the club 106 in order to develop a feel of an actual downswing.

The system 100 of links and the holder 104 is then used to train the trainee golfer to perform downswings. The trainee golfer then hits shots from his ODP which can be tracked with previously known radar-based technology for comparison to his or her previous method, or, to start a new golfer on a correct learning path. Once the golfer has "seen the light" that his or her efficiency is improved, the DPG Instructor will begin with teaching a grip. The key here is that the beginning point will be his or her grip taken in the ODP. This is a significant aspect of the DPG Machine 100 in that a golfer's grip of the club handle will be different (estimates are 95% of the time) when taken in his or her ODP than when taken in the traditional address position. Herein lies the main reason that most golfers fail to swing the club 106 up successfully to their ODP.

The DPG instructor will then ask the golfer to take his or her grip in his ODP and then remove the club 106 from the machine 100 and bring it down to the traditional address position. Here, he or she will feel the difference immediately between where his or her hand grip has been and where the DPG Machine 100 mandates how he or she hold the club handle. Some golfers will find this to be a subtle adjustment, yet others may find it to be quite radically different. Once it has been determined that the golfer's success is contingent upon this new grip, golfer and instructor will begin working from a traditional address position with the new grip to take the club back to the ODP being located by the DPG machine 100.

The next area of focus is to consistently backswing the club 106 using the DPG grip to the ODP. This can be done initially in a rehearsal stage wherein the machine stands behind the person in a traditional address position, golfer backswings his or her club 106 using DPG grip up into the ODP. Additionally, graphic software can be used with monitors on both front view and a view down the ball flight line 124, FIG. 1B (following the ball flight) to show the golfer while he or she swings, where his or her ODP is located. When he or she swings the club 106 up, reaching his or her ODP, there can be an auditory beep signal that he or she is in his optimal spot.

For golfers whose DPG grip is radically different than their previous grip, a DPG instructor can construct a moldable grip from rubberized plastic material that can be installed over the shaft of a practice club 106, which molds to the golfer's hands when taken in their ODP position. After the molded grip material sets to a permanent configuration, the golfer has a starting point from which to return for all practice shots.

Once a DPG instructor and student have recognized the efficiency of the ODP, instructor has opportunity to sell DPG home model, DPG molded grips, DPG graphic software, and future lessons.

This description of the exemplary embodiments is intended to be read in connection with the accompanying drawings, which are to be considered part of the entire written description. In the description, relative terms such as "lower," "upper," "horizontal," "vertical,", "above," "below," "up," "down," "top" and "bottom" as well as derivative thereof (e.g., "horizontally," "downwardly," "upwardly," etc.) should be construed to refer to the orientation as then described or as shown in the drawing under discussion. These relative terms are for convenience of description and do not require that the apparatus be constructed or operated in a particular orientation. Terms concerning attachments, coupling and the like, such as "connected" and "interconnected," refer to a relationship wherein structures are secured or attached to one another either directly or indirectly through intervening structures, as well as both movable or rigid attachments or relationships, unless expressly described otherwise.

Patents, publications and patent applications referred to herein are hereby incorporated by reference in their entireties. Although the invention has been described in terms of exemplary embodiments, it is not limited thereto. Rather, the appended claims should be construed broadly, to include other variants and embodiments of the invention, which may be made by those skilled in the art without departing from the scope and range of equivalents of the invention.

What is claimed is:

1. A golf training apparatus, comprising:

a system of links and a holder for holding a golf club in a correct position for beginning a golf swing at initiation of a downswing, wherein the apparatus is disposed to eliminate a backswing of the club; and the holder being adapted to separate from the club, wherein the entire apparatus is separate from the club during a downswing of the club, wherein the holder comprises a plane board and multiple pins holding the golf club in an optimal downswing plane at initiation of the downswing.

2. The training apparatus of claim 1, comprising:

the holder holding the club stationary in said optimal position for a person to apply a properly configured golf grip on the club for beginning a golf swing at initiation of a downswing.

3. The training apparatus of claim 1, comprising:

the system of links and a holder being dimensionally scaled to the dimensions, proportions and flexibility of said person, and holding the club at the same optimal position as would said person.

4. The training apparatus of claim 1, comprising:

the holder positioning the club in conformance with an individual golfer's preferred optimal position to initiate a downswing, from a less than horizontal position, a horizontal position or beyond a horizontal position of the club shaft.

5. The training apparatus of claim 1, comprising:

the holder having a stop against which a clubhead of the club engages to prevent the club from moving beyond the optimal position.

6. The training apparatus of claim 1, comprising:

the holder being open along a top of the holder to unload the club from the top of the holder at a beginning of said downswing of the club.

7. The training apparatus of claim 1, comprising:

the holder being moveable with the club at a beginning of said downswing; and the holder being open along a top of the holder to unload the club from the open top of the holder during said downswing of the club.

8. The training apparatus of claim 1, wherein the holder is adjustable to one of a series of optimal positions commensurate with variations in standard club length.

9. The training apparatus of claim 1, further comprising:

a mat having transducers monitoring the weight on respective feet of the person, and detecting the relative weight distribution.

10. The training apparatus of claim 1, further comprising:

a mat having transducers monitoring the weight on respective feet of the person to be trained, and detecting the relative weight distribution and detecting the center of gravity of the person.

11. A method of training a golf swing, comprising:

holding a golf club stationary in a holder that holds the club in a correct position for initiating a downswing of the club, while applying a properly configured golf grip on the club;

removing the club from the holder and assuming an address position; and rehearsing a backswing of the club to return the club to the holder, wherein the holder comprises a plane board and multiple pins holding the golf club in an optimal downswing plane at initiation of the downswing.

12. The method of claim 11, comprising:

performing a golf swing after returning the club to the holder, by beginning the golf swing at initiation of a downswing of the club, while the holder separates from the club at initiation of the downswing.

13. The method of claim 11, comprising:

performing a golf swing after returning the club to the holder, by beginning the golf swing at initiation of a downswing of the club, while the holder moves with the club at the beginning of the downswing and thereafter the holder separates from the club during the downswing.

14. A method of training a golf swing, comprising:

holding a golf club stationary in a holder that holds the club in a correct position for initiating a downswing of the club, while applying a properly configured golf grip on the club; and performing a golf swing by beginning the golf swing at initiation of a downswing of the club, while the holder separates from the club at initiation of the downswing, wherein the holder comprises a plane board and multiple pins holding the golf club in an optimal downswing plane at initiation of the downswing.

15. A method of training a golf swing, comprising:

holding a golf club stationary in a holder that holds the club in a correct position for initiating a downswing of the club, while applying a properly configured golf grip on the club; and performing a golf swing by beginning the golf swing at initiation of a downswing of the club, while the holder moves with the club at the beginning of the downswing and thereafter the holder separates from the club during the downswing, wherein the holder comprises a plane board and multiple pins holding the golf club in an optimal downswing plane at initiation of the downswing.

16. A method for golf training, comprising:

dimensionally scaling a system of links and a holder according to dimensions and proportions and flexibility of a person to be trained by the system; and positioning the system of links and a holder to hold a golf club at the same correct position for initiating a downswing of the club, as would said person to be trained; and holding the club stationary in said correct position for said person to be trained to apply a properly configured golf grip on the club, wherein the holder comprises a plane board and multiple pins holding the golf club in an optimal downswing plane at initiation of the downswing.

17. The method of claim 16, comprising:

removably holding the club in said holder for a downswing of the club, and adapting the golf club for leaving the holder during such downswing of the club by the person to be trained.

18. The method of claim 16, comprising:

providing a golf ball in position relative to said system of links and a holder; and removably holding the club in said holder for a downswing of the club, and adapting the golf club for leaving the holder during such downswing of the club by the person to be trained.

19. The method of claim 16, comprising:

monitoring the weight on respective feet of the person to be trained, and detecting the relative weight distribution.

20. The method of claim 16, comprising:

monitoring the weight on respective feet of the person to be trained, and detecting the relative weight distribution and detecting the center of gravity of the person to be trained.

* * * * *